US005564184A

United States Patent [19]

Dinh

[11] Patent Number: 5,564,184

[45] Date of Patent: Oct. 15, 1996

[54] METHOD FOR MAKING HEAT PIPES

[75] Inventor: Khanh Dinh, Gainesville, Fla.

[73] Assignee: Heat Pipe Technology, Inc., Alachua, Fla.

[21] Appl. No.: 543,331

[22] Filed: Oct. 16, 1995

Related U.S. Application Data

[62] Division of Ser. No. 190,875, Feb. 2, 1994, abandoned.

[51] Int. Cl.[6] ..... B23P 15/26

[52] U.S. Cl. ..... 29/890.044; 29/890.046; 29/890.048; 29/727

[58] Field of Search ..... 29/890.044, 890.046, 29/890.048, 890.049, 890.053, 727

[56] References Cited

U.S. PATENT DOCUMENTS

| | | | |
|---|---|---|---|
| 4,646,548 | 3/1987 | Zimmerli et al. | 29/890.049 |
| 4,706,355 | 11/1987 | Kuhn et al. | 29/890.049 |
| 5,295,303 | 3/1994 | Ogawa et al. | 29/890.049 |
| 5,351,397 | 10/1994 | Angeli | 29/890.049 |

FOREIGN PATENT DOCUMENTS

| | | | |
|---|---|---|---|
| 0074153 | 6/1977 | Japan | 29/890.044 |
| 0130352 | 10/1980 | Japan | 29/890.044 |
| 0149737 | 11/1980 | Japan | 29/890.044 |
| 0173043 | 10/1983 | Japan | 29/890.044 |
| 0010427 | 1/1984 | Japan | 29/890.044 |
| 0040624 | 3/1985 | Japan | 29/890.044 |

*Primary Examiner*—Irene Cuda
*Attorney, Agent, or Firm*—Nilles & Nilles

[57] ABSTRACT

A metalworking tool is capable of making internally grooved and externally finned heat exchanger coils from ordinary tubes in a single operation in which the tubes are expanded into bonding mechanical contact with external fins at the same time that grooves are formed in the inner surfaces of the tubes. The process is performed by a tool head having both expanding and groove forming tools mounted thereon. The expanding tool preferably comprises a hardened expansion ball which mechanically expands the tube with or without hydraulic or pneumatic assist. The groove forming tool may comprise a cutting point which scribes the tube, a roller which forges a groove, or any other suitable scribing or forging device. The groove forming tool may rotate or oscillate to produce nonlinear grooves and may form grooves during the in-going and/or out-going strokes of the tool.

18 Claims, 5 Drawing Sheets

METHOD FOR MAKING HEAT PIPES

This application is a continuation of application Ser. No. 08/190,875, filed Feb. 2, 1994, now abandoned.

BACKGROUND OF THE INVENTION

1. Field of the Invention

The invention relates to a method and apparatus for making heat exchangers, and more particularly, relates to a method and apparatus for making heat exchangers having internally grooved and externally finned coils which form a coil slab.

2. Discussion of Related Art

So called "heat pipes" are becoming increasingly popular for passive heat transfer for heating, cooling and/or dehumidification purposes. The typical heat pipe includes a plurality of vertical or inclined copper tubes thermally and mechanically connected to one another by stacks of perforated aluminum fins which also serve to promote heat transfer between the tubes and the surrounding environment. These tubes are charged with a refrigerant and arranged such that the upper and lower portions of the tubes are in thermal contact with relatively cool and relatively warm environments, respectively. Refrigerant in the lower portion of each of the tubes receives heat from the relatively warm environment, vaporizes, and rises into the upper portion, where it transfers heat to the relatively cool environment, condenses, and flows back into the lower portion, thus repeating the cycle. The lower portion of a heat pipe thus acts as an evaporator which cools and dehumidifies the surrounding environment, and the upper portion acts as a condenser which warms the surrounding environment. The efficiency of the tubes forming the coils of such heat pipes can be significantly enhanced by forming the tubes with internal grooves which, (1) increase the effective surface area of the inner surfaces of the tubes and thus increase heat transfer area, and (2) act as wicks increasing capillary action and promoting refrigerant flow through the tubes.

Heat pipes and other heat exchanger coils are normally constructed in the following manner. The tubes are inserted through a stack of perforated fins such that collars of the fins surround the tubes with narrow gaps formed therebetween. An expanding tool such as a hard metal ball is then forced through the tubes to expand them beyond their elastic limits into contact with the collars of the fins, thereby permanently increasing the tube diameters and forming a secure mechanical bond between the tubes and the fins. Grooves are scribed or otherwise formed in the tubes either prior to or following this expansion operation, and the tubes are charged with a refrigerant and sealed and/or connected to one another to form coils. The resulting assembly, often called a coil slab, is now ready for use as a heat pipe or another heat exchanger coil.

The primary disadvantage of the process described above is that the tubes must be expanded and grooved in separate steps using separate expanding and groove forming tools. This not only increases production time by at least a factor of two as compared to either the expansion or the groove forming operation, but also greatly increases tooling costs and labor expense.

OBJECTS AND SUMMARY OF THE INVENTION

It is therefore and object of the invention to provide a method for the simplified production of internally grooved and externally finned heat exchanger coils.

Another object of the invention is to fabricate internally grooved and externally finned heat exchanger coils rapidly while employing a minimum of equipment.

In accordance with a first aspect of the invention, these and other objects of the invention are achieved by providing a method comprising expanding a tube into fitting engagement with external fins, and forming a groove in an inner surface of the tube. The expanding and grooving steps are performed using a single tool head on which are mounted an expanding tool and a groove forming tool.

The grooving step may be performed during both in-going and out-going strokes of the tool head, or during only one of an in-going and an out-going stroke of the tool head.

The grooves may be linear, or non-linear grooves can be formed by rotating the tool head during the cutting step. The rotating step may comprise unidirectionally rotating the tool head to form spiral grooves in the tube or oscillating the tool head to form non-rectilinear grooves in the tube.

Yet another object of the invention is to provide a relatively simple and inexpensive apparatus for quickly and efficiently producing internally grooved and externally finned heat exchanger coils.

In accordance with another aspect of the invention, this object is achieved by providing a metal working tool comprising a tool head movable axially through a tube, an expanding tool mounted on the tool head and adapted to expand the tube, and a groove forming tool mounted on the tube head and adapted to form a groove in the tube.

The expanding tool may comprise an expansion ball having a maximum diameter larger than the initial inside diameter of the tube. The groove forming tool may comprise a cutting point mounted on the tool head or a disk rotatably mounted on the tool head. In either event, means may be provided for mounting the groove forming tool on the tool head such that the groove forming tool forms a groove in the tube only when the tool moves in a designated axial direction.

It may in some instances be desirable to form non-linear grooves in the tube. To this end, means may be provided for rotating the tool head as the tool head moves through the tube. The means for rotating may comprise at least one of an external drive device and a splined connection of the groove forming tool to the tool head.

Other objects, features, and advantages of the invention will become apparent from the following detailed description and accompanying drawings. It should be understood, however, that the detailed description and specific examples, while indicating preferred embodiments of the present invention, are given by way of illustration and not of limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout and in which.

DETAILED DESCRIPTION OF THE PREFERRED EMBODIMENTS

1. Resume

Pursuant to the invention, a method and apparatus are provided for making internally grooved and externally finned heat exchanger coils from ordinary tubes in a single operation in which the tubes are expanded into bonding contact with external fins at the same time that grooves are formed in the inner surfaces of the tubes. The process is performed by a tool head having both expanding and groove forming tools mounted thereon. The expanding tool preferably comprises a hardened expansion ball which mechanically expands the tube with or without hydraulic or pneumatic assist. The groove forming tool may comprise a cutting point which scribes the tube, a roller which forges a groove, or any other suitable scribing or forging device. The groove forming tool may rotate or oscillate to produce nonlinear grooves and may form grooves during the in-going and/or out-going strokes of the tool.

2. Principle of Operation and Construction and Operation of First Embodiment

Figure 1:
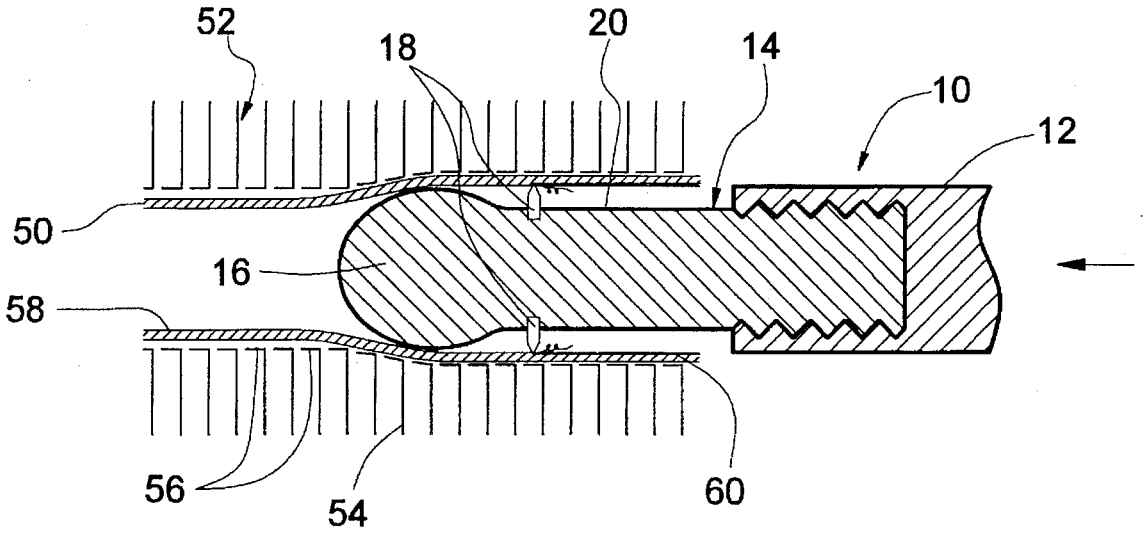
FIG. 1 is a sectional side elevation view illustrating the operation an tube expanding and groove forming tool constructed in accordance with a first preferred embodiment of the present invention.

Referring now to FIG. 1, a tube expanding and groove forming tool 10 is provided for fabricating a coil slab heat exchanger-type heat pipe or the like having internally grooved and externally finned coils. As is conventional with such heat pipes, each coil is formed from one or more tubes 50 designed to contain a refrigerant which exchanges heat with the outside environment with the assistance of a fin stack 52 formed from fins 54 mechanically bonded to the exterior of the tube 50 by expansion of the tube 50. Dozens or even hundreds of the tubes 50 will typically be connected to one and other to form one or more continuous coils extending through the slab.

Each tube 50 and the associated fin stack 52 are constructed out of relatively malleable conductive metals and are typically produced from copper and aluminum, respectively. The fin stack 52 is formed from a plurality of fins 54 perforated in a press and having collars 56 formed around the perforations for good thermal and mechanical contact with the tube 50. Collars 56 initially receive the tubes 50 with a narrow gap formed therebetween to permit assembly but become mechanically bonded to the tube 50 when the tube 50 is expanded as illustrated in the right half of FIG. 1. The inner surface 58 of each tube 50 is formed with internal grooves 60 which promote fluid flow along the inner surfaces 58 of the tubes 50 and also increase the heat transfer surface area of the inner surface 58.

The tube expanding and groove cutting tool 10 includes a drive shaft 12 to which is attached a tool head 14. The drive shaft 12, though illustrated as a solid metal shaft, could comprise any device capable of propelling the tool head 14 through the tube 50 with sufficient forces to expand the tube 50 and to form grooves 60 in the inner surface 58 of the tube 50. Drive shaft 12 may be driven manually but is preferably powered by a suitable electric, hydraulic, or pneumatic motor which does not itself form part of the present invention. Drive shaft 12 could also be formed integrally with the tool head 14 but in the preferred embodiment detachably receives the tool head 14, e.g., by threading, to permit removal of the tool head 14 for maintenance or replacement.

The tool head 14 may comprise any device powered manually or automatically by the drive shaft 12 to both (1) expand the tube 50 beyond its elastic limit to form a mechanical bond with the collars 56 of the fins 54, and (2) form one or more grooves 60 into the inner surface 58 of tube 50. The expansion could be performed purely mechanically, purely hydraulically or pneumatically, or under a combination of mechanical and hydraulic or pneumatic forces. The grooves 60 may be formed by cutting, scribing, forging, or any other suitable operation. In the illustrated embodiment, the expanding and groove forming are performed by a separate expander tool 16 and groove forming tools 18 mounted on a push rod 20 of the tool head 14 which is in turn coupled to the drive shaft 12.

The expander tool 161of the illustrated embodiment comprises an expansion ball mounted on the end of push rod 20. The expansion ball 16 has a maximum radius which is sufficiently greater than the initial inside radius of the tube 50 to expand the tube 50 beyond its elastic limit.

Each groove forming tool 18 of the illustrated embodiment comprises a cutting point formed from hardened steel or the like, mounted on the push rod 20 behind the expansion ball 16, and extending radially from the tool head 14 slightly beyond the maximum radius of the expansion ball 16 so as to cut or scribe grooves 60 in the inside surface 58 of the tube 50 when the tool head 14 passes through the tube 50. Of course, the number of grooves 60 formed will be determined by the number of cutting points 18 mounted on the tool head 14. Two such cutting points 18 are illustrated and are fixed to the push rod 20, e.g., by screws, and thus are capable for forming grooves 60 in the tube 50 during both the in-going and out-going strokes of the tool head 14.

In use, the tool head 14 is propelled axially through the tube 50 by the drive shaft 12 in a two stroke (in-going and out-going) process. Movement of the relatively large expansion ball 16 through the tube 50 permanently increases the diameter of the tube 50 beyond its elastic limit by a sufficient amount to mechanically bond the tube 50 to the collars 56 of the fins 54. The hardened cutting points 18 cut or scribe small grooves 60 in the inner surface 58 of the tube 50 during the in-going stroke and return within the same grooves during the out-going stroke unless the cutting tool 10 is rotated or otherwise moved radially with respect to the tube 50. The tube 50 is thus both expanded and grooved in a single process using only a single tool head 14. This represents significant advantages over all known prior art processes.

3. Construction of Second Embodiment

Grooves can be formed in the inner surfaces tubes by means other than cutting. For instance, referring to FIG. 2 grooves 160 can be forged into inner surface 158 of the tube 150 by rotatable disks 118. The disks 118 are rotatably mounted in arcuate slots 122 formed in the push rod 120 of the tool head 114 by shafts 124 extending into the slots 122. The disks 118 extend radially from the push rod 120 by a distance which is slightly greater than the maximum radius of the expansion ball 116 so as to engage and forge grooves 160 into the inner surface 158 of tube 150 after the tube 150 is expanded by the expansion ball 116. As in the first embodiment, the grooves 160 may be formed during at least the in-going and possibly during both the in-going and out-going strokes of the tool head 114. The tube expanding and groove forming tool 110 including tool head 114 is otherwise identical in construction and operation to the tool 10 of the first embodiment and thus will not be described in detail. Suffice it to say that elements of the tool 110 corresponding to those of the tool 10 of the first embodiment are denoted by the same reference numerals, incremented by 100.

4. Description and Operation of Retractable Groove Forming Tools

Figure 2:
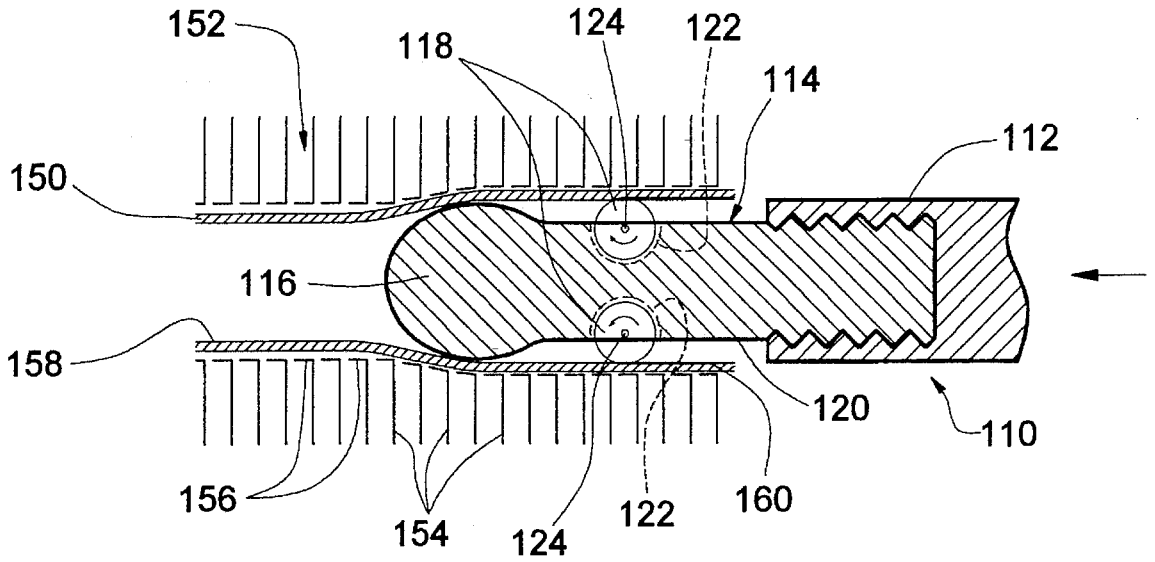
FIG. 2 is a sectional side elevation view of a tube expanding and groove forming tool constructed in accordance with a second embodiment of the invention.
Figure 3:
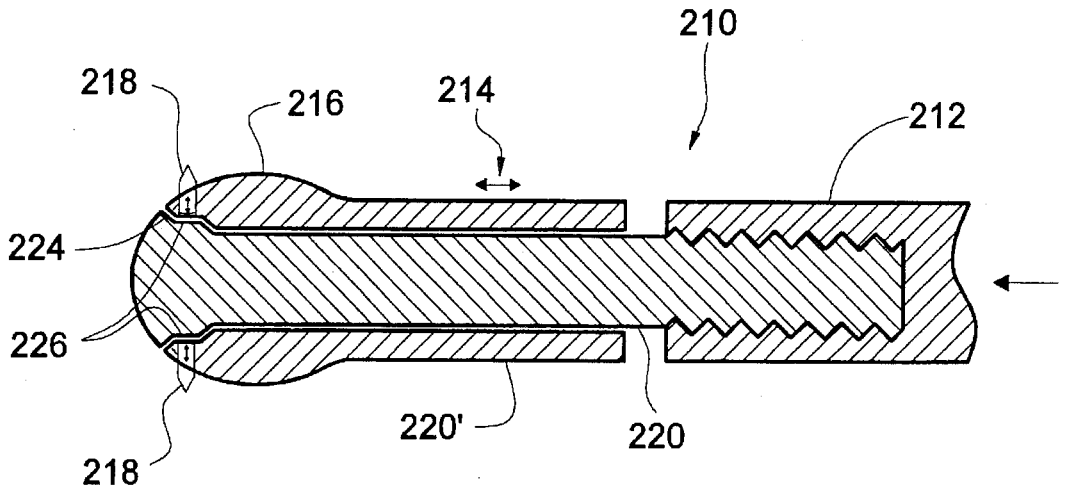
FIG. 3 is a sectional side elevation view of a tube expanding and groove forming tool constructed in accordance with a third embodiment of the invention.

It may in some instances be desirable not to form grooves in the inside surface of a tube during both the in-going and out-going strokes of a groove forming tool. For instance, it is possible that during the in-going stroke the groove forming tool can generate metal fillings, dust, or other debris which could "gum up" the expanding tool during the out-going stroke of the tool head. This problem can be avoided by modifying the tool head such that the groove forming stroke is performed only during the out-going stroke such that the debris does not interfere with primary operation of the expanding tool. Thus, as illustrated in FIG. 3, a tube expanding and groove forming tool 210 can be provided having a two piece tool head 214 in the form of a sleeve 220' which is slidably axially mounted on a push rod 220 threadedly or otherwise attached to a drive shaft 212. The sliding sleeve 220' is enlarged at its front end to present an expansion ball 216, and has radial slots formed therein for slidably receiving the cutting points 218. The cutting points 218 may be held in the radial slots of the sleeve 220' by any suitable device permitting movement of the cutting points 218 radially through the sleeve 220' while retaining the cutting points 218 in the slots. The push rod 220 is stepped, flared, or otherwise widened at its front end 224 so as to 1) selectively engage the bases 226 of the cutting points 218 and to force the cutting points 218 to move through the radial slots into their fully extended positions illustrated in FIG. 3 when the sleeve 220' is pulled to the free end of the push rod 220 also as illustrated in FIG. 3, and 2) to permit the bases 226 of the cutting points 218 to slide into an annular gap which is formed between the sleeve 220' and the push rod 220 when the sleeve 220' is pushed to the shaft end of the push rod 220.

In use, the sleeve 220' is forced towards the shaft end of the push rod 220 during the in-going stroke of the tool head 214 (by contact with the outer surface of the tube) to define an annular gap between the sleeve 220' and the push rod 220. The cutting points 218 are forced into this gap by contact with the inner surface of the tube and thus do not cut or otherwise form grooves in the inner surface of the tube during the in-going stroke. During the out-going stroke of the tool head 214, on the other hand, the sleeve 220' is pulled to the free end of the push rod 220 as illustrated in FIG. 3 by contact with the inside surface tube. The bases 226 of the cutting points 218 thus engage the widened end surface 224 of the push rod 220 so as to force the tips of the cutting points 218 beyond the radial edge of the expansion ball 216 formed by the sleeve 220'. The tips of the cutting points 218 thus scribe grooves in the inside surface of the tube. The structure and operation of the elements of the tool 210 of the embodiment of FIG. 3 are otherwise identical to those of the tool 10 of the first embodiment and, accordingly, will not be described in detail and are denoted by the same reference numeral, increased by 200.

Figure 4:
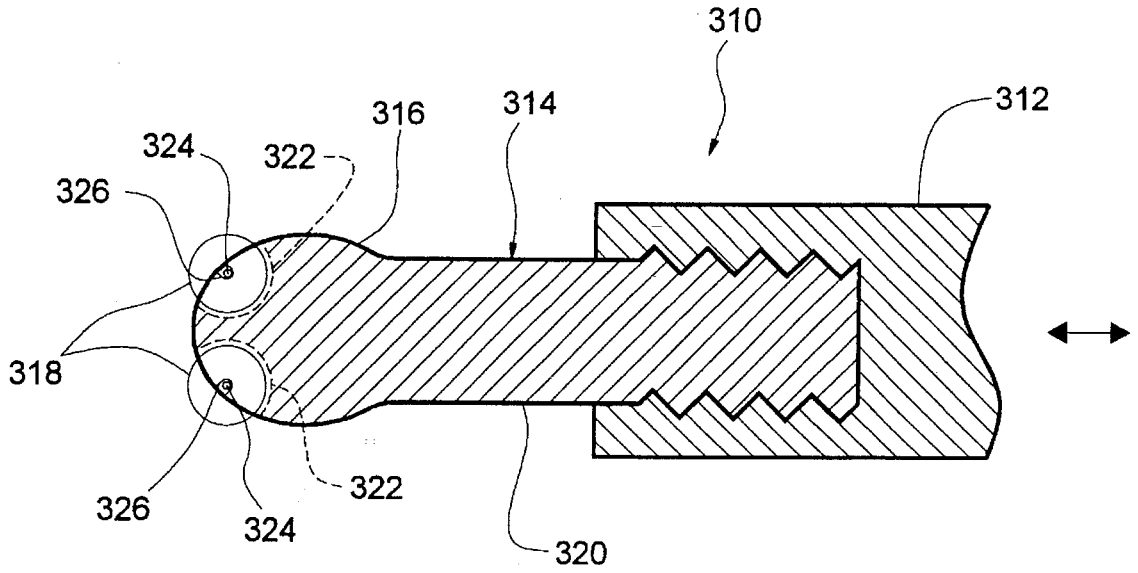
FIG. 4 is a sectional side elevation view of a tube expanding and groove forming tool constructed in accordance with a fourth embodiment of the invention.

Notwithstanding the previous discussion, it may in some instances be desirable to form grooves in a tube only during the in-going stroke of the tool head. To this end, referring to FIG. 4, a tube expanding and groove forming tool 310 is illustrated having rotatable disks 318 mounted by shafts 324 in arcuate slots 322 formed in the front of the tool head 314 thereof and extending radially by a distance which is less than the maximum radius of the expansion ball 316 but slightly greater than the initial inside radius of the tube. Disks 318 thus engage and forge grooves in the unexpanded tube surface during the in-going stroke of the tool head 314 but do not engage the expanded tube surface during the out-going stroke of the tool head 314. This effect can, if desired, be reversed by movably mounting the shafts 324 of the disks 318 in slanted slots 326 formed in the tool head 314 to extend the disks 318 during the out-going stroke of the tool head 314, thereby causing grooves to be forged only during the outgoing stroke. As would be readily understood by those skilled in the art from consideration of FIG. 4, pushing forces imposed on the inner or front ends of the rollers 318 during ingoing strokes cause the rollers 318 to retract or move inwardly along the slots 326 so as not to forge grooves in the unexpanded tube, and pushing forces imposed on the outer or rear ends of the rollers 318 during the outgoing strokes cause the rollers to extend or move outwardly along these slots so as to form grooves in the expanded tube. The construction and operation of the tool 310 of FIG. 4 are otherwise identical to the tool 110 of FIG. 2 and, accordingly, will not be described in detail and are denoted by the same reference numeral, incremented by 200.

5. Construction and Operation of Rotatable Groove Forming Tools

Figure 5:
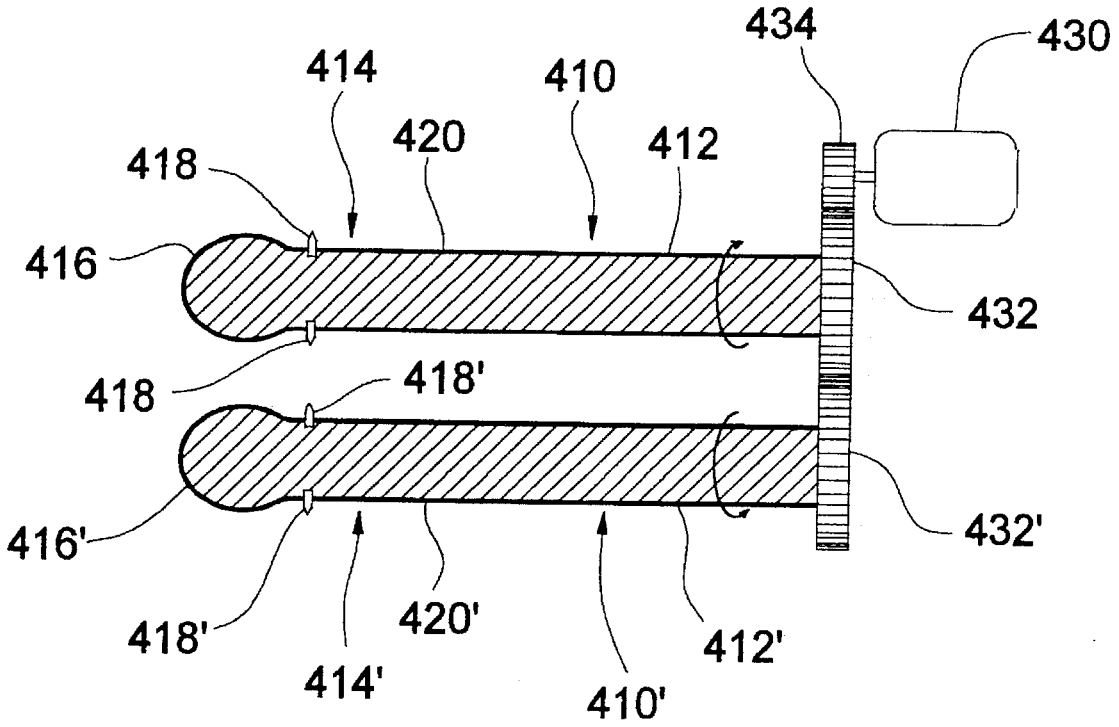
FIG. 5 is a sectional side elevation view of a tube expanding and groove forming tool constructed in accordance with a fifth embodiment of the invention.

The tool heads and corresponding drive shafts of all of the embodiments described above are capable of forming only linear grooves in,the tubes. It may in some instances be desirable to form nonlinear grooves in such tubes. Referring to FIG. 5, one such device for forming such grooves includes first and second tube expanding and groove forming tools 410, 410' driven to rotate by a common electric motor 430. As with the previous embodiments, each tool 410, 410' includes a drive shaft 412, 412' to which is attached a tool head 414, 414'. Drive shaft 412 of the first tool 410 receives a gear 432 directly driven by the output drive gear 434 of the motor 430, and the drive shaft 412' of the second tool 410' receives a second gear 432' which is driven by the first gear 432. The gears 432, 432' may be splined onto the drive shafts 412, 412' to permit axial movement of the drive shafts 412, 412' with respect to the gears 432, 432' during the in-going and out-going strokes of the tool heads 414, 414', or may be fixed to the shafts 412, 412' and be adapted to move with the shafts 412, 412' during the in-going and out-going strokes. The heads 414, 414' are the same in construction and operation as that of the first embodiment and thus each include an expansion ball 416, 416' and a pair of cutting points 418, 418' fixed to a push rod 420, 420' of the tool head 414, 414'.

In operation, the motor 430 is activated to drive the shafts 412, 412' to rotate during the in-going and/or outgoing strokes of the tool heads 414, 414'. This rotation may be unidirectional, thus resulting in the formation of spiral grooves in the tubes. Alternatively, the motor 430 may be reversible so as it impart oscillatory motion to the shafts 412, 412', thereby forming non-rectilinear grooves in the inner surfaces of the tubes.

The electric motor 430 could be replaced by any suitable device capable of imparting rotational or oscillatory motion to the shafts 412, 412' and/or could be used to rotate any number of shafts. Motor 430 could also be eliminated altogether, and the cutting points or roller disks could be splined onto the push rods 420, 420' to spin by themselves upon engagement with the inner surfaces of the tubes as the tool heads move through the tubes, thereby forming nonlinear grooves.

Many changes and modifications could be made to the invention without departing from the spirit thereof. For instance, as discussed above, the expansion balls described above could be replaced by or supplemented with devices for hydraulically or pneumatically expanding the tubes. If a purely hydraulic or pneumatic expansion device were to be employed, the tool head would merely act as a conduit for such an expansion device and as a support for the groove forming device. In addition, injection ports could be provided in the tool head for injecting pressurized fluid into the tube to clear debris from the tube during at least the out-going stroke. The scope of these and other changes and modifications falling within the spirit of the invention will become apparent from the appended claims.

I claim:

1. A method of expanding a tube and forming a groove in said tube comprising:

providing a tube expanding and groove forming tool with a drive shaft having a longitudinal axis.

a tool head attached to said drive shaft, said tool head having an expander tool, and a groove forming tool mounted on said tube expanding and groove forming tool, said groove forming tool including a rolling element mounted on said tube expanding and groove forming tool 0rid rotatable with respect to said groove forming tool about an axis which is at least generally perpendicular to said longitudinal axis of said drive shaft;

inserting said tool head into said tube, thereby expanding said tube; and withdrawing said tool head from said tube;

forming a groove in said tube during at least one of the inserting and withdrawing steps, wherein said forming step comprises spinning said rolling element about said axis of rotation upon engagement with an inner surface of said tube, thereby forging said groove without cutting.

2. The method of claim 1, wherein said forming step is performed only during said withdrawing step.

3. The method of claim 1, further comprising rotating said tool about said longitudinal axis of said drive shaft during the groove forming step, thereby forming a non-linear groove in said tube.

4. The method of claim 3, wherein said rotating step includes unidirectionally rotating said tool head, thereby forming a spiral groove in said tube.

5. The method of claim 3, wherein said rotating step includes oscillating said tool head, thereby forming a non-rectilinear groove in said tube.

6. The method as defined in claim 1, wherein the step of providing a rolling element comprises providing a rotatable disk mounted on a shaft extending perpendicular to said longitudinal axis of said drive shaft.

7. The method as defined in claim 6, wherein said shaft is rotatably and slidably mounted in an inclined slot formed in said tool head, said shaft retracts within said inclined slot during said inserting step so as not to forge said groove, and said shaft extends within said inclined slot during said withdrawing step so as to forge said groove.

8. A method of expanding a tube and forming a groove in said tube, said method comprising:

providing a tube expanding and groove forming tool with a drive shaft, a tool head having a first end attached to said drive shaft, a second end, and an expander tool a widest portion of which is located between said first and second ends, and a groove forming tool mounted on said tool head between said widest portion of said expander tool and said second end;

inserting said tool head into said tube, thereby expanding said tube; then withdrawing said tool head from said tube; and forming a groove in said tube only during said withdrawing step.

9. The method as defined in claim 8, wherein the step of providing a groove forming tool comprises providing a rolling element mounted on said tool head and rotatable with respect to said tool head about an axis which is at least generally perpendicular to a longitudinal axis of said drive shaft, and wherein said forming step comprises spinning said rolling element about said axis of rotation upon engagement with an inner surface of said tube, thereby forging said groove without cutting.

10. The method as defined in claim 9, wherein the step of providing a rolling element comprises providing a rotatable disk.

11. The method as defined in claim 9, wherein said step of providing said rolling element comprises providing a rolling element which is mounted on a shaft, said shaft being rotatably and slidably mounted in an inclined slot formed in said tool head, said shaft retracts within said inclined slot during said inserting step so that said rolling element does not forge a groove, and said shaft extends within said inclined slot during said withdrawing step so that said rolling element forges said groove.

12. The method as defined in claim 8, wherein the step of providing a groove forming tool comprises providing a scribing point which is non-rotatably mounted on said tool head, and wherein said forming step comprises scribing an inner surface of said tube with said scribing point, thereby cutting said groove.

13. The method as defined in claim 10, wherein the step of providing said scribing point comprises providing a scribing point which is retractably mounted on said tool head, said scribing point retracts within said tool head during said inserting step so as not to cut said groove, and said scribing point extends within said tool head during said withdrawing step so as to cut said groove.

14. A method of expanding a tube and forming a groove in said tube comprising:

providing a tube expanding and groove forming tool with a drive shaft having a longitudinal axis, a tool head attached to said drive shaft, said tool head having an expander tool, and a rolling element mounted on a shaft, said shaft being slidably mounted in an inclined groove formed in said tube expanding and groove forming tool and being rotatable with respect to said tool head about an axis of rotation which is at least generally perpendicular to said longitudinal axis of said drive shaft;

inserting said tool head into said tube, thereby expanding said tube and causing said rolling element to retract within said slot so as not to forge a groove in said tube; and withdrawing said tool head from said tube, thereby causing said rolling element to extend within said slot into pressurized rolling engagement with said tube and forging said groove in said tube without cutting.

15. The method as defined in claim 14, wherein the step of providing a rolling element comprise providing a rotatable disk.

16. The method of claim 14, further comprising rotating said tool head about said longitudinal axis of said drive shaft during said withdrawing step, thereby forming a non-linear groove in said tube.

17. The method of claim 16, wherein said rotating step includes unidirectionally rotating said tool head, thereby forming a spiral groove in said tube.

18. The method of claim 16, wherein said rotating step includes oscillating said tool head, thereby forming a non-rectilinear groove in said tube.

* * * * *

UNITED STATES PATENT AND TRADEMARK OFFICE

CERTIFICATE OF CORRECTION

PATENT NO. : 5,564,184
DATED : October 15, 1996
INVENTOR(S) : Khanh Dinh

It is certified that error appears in the above-indentified patent and that said Letters Patent is hereby corrected as shown below:

On the title page, delete "[62] Division of Ser. No. 190,875, Feb. 2, 1994, abandoned." and substitute -- [62] Continuation of Ser. No. 190,875, Feb. 2, 1994, abandoned. --

Column 7, Line 25, delete "0rid" and substitute --and--.

Signed and Sealed this

Twenty-fourth Day of December, 1996

*Attest:*

Bruce Lehman

BRUCE LEHMAN

*Attesting Officer*

*Commissioner of Patents and Trademarks*